US011380166B2

(12) United States Patent
Meyer

(10) Patent No.: US 11,380,166 B2
(45) **Date of Patent: *Jul. 5, 2022**

(54) GAMING MACHINE AND METHOD HAVING BONUS GAME TRIGGER ADJUSTMENTS BASED ON SUPPLEMENTAL DATA

(71) Applicant: Everi Games, Inc., Austin, TX (US)

(72) Inventor: Steven Meyer, Austin, TX (US)

(73) Assignee: Everi Games, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/186,912

(22) Filed: Feb. 26, 2021

(65) Prior Publication Data

US 2021/0183206 A1 Jun. 17, 2021

Related U.S. Application Data

(63) Continuation of application No. 16/803,431, filed on Feb. 27, 2020, now Pat. No. 10,943,434, which is a continuation of application No. 15/881,618, filed on Jan. 26, 2018, now Pat. No. 10,636,525.

(60) Provisional application No. 62/566,894, filed on Oct. 2, 2017.

(51) Int. Cl.
*G07F 17/34* (2006.01)
*G07F 17/32* (2006.01)

(52) U.S. Cl.
CPC ..... *G07F 17/3267* (2013.01); *G07F 17/3213* (2013.01); *G07F 17/3244* (2013.01); *G07F 17/34* (2013.01)

(58) Field of Classification Search
CPC .. G07F 17/3267; G07F 17/34; G07F 17/3244; G07F 17/3213
See application file for complete search history.

(56) References Cited

U.S. PATENT DOCUMENTS

2002/0090990 A1* 7/2002 Joshi ..... G07F 17/3213 463/20
2003/0008705 A1* 1/2003 Baerlocher ..... G07F 17/34 463/20
2003/0073482 A1* 4/2003 Baerlocher ..... G07F 17/3213 463/20
2003/0073483 A1* 4/2003 Glavich ..... G07F 17/3267 463/20
2004/0137982 A1* 7/2004 Cuddy ..... G07F 17/3265 463/20
2006/0030391 A1* 2/2006 Casey ..... G07F 17/3267 463/16
2006/0040734 A1* 2/2006 Baerlocher ..... G07F 17/3267 463/26

(Continued)

*Primary Examiner* — Steve Rowland
(74) *Attorney, Agent, or Firm* — The Culbertson Group, P.C.; Nathan H. Calvert

(57) ABSTRACT

Methods and systems facilitate the adjustment of probabilities of triggering different bonus games in a slot machine where the probability adjustment is based on supplemental data. Programming and data structure design are provided to implement a bonus trigger probability adjusting arrangement based on supplemental data input. Such supplemental data includes the state of a dynamic interactive game theme sequence displayed at the gaming machine. Player inputs can alter the sequence of the theme display and affect the adjustment of probabilities.

15 Claims, 7 Drawing Sheets

(56) References Cited

U.S. PATENT DOCUMENTS

| | | | | |
|---|---|---|---|---|
| 2006/0211466 | A1* | 9/2006 | Ward | G07F 17/3211 463/16 |
| 2007/0167208 | A1* | 7/2007 | Acres | G07F 17/32 463/16 |
| 2009/0011826 | A1* | 1/2009 | Acres | G07F 17/32 463/27 |
| 2010/0004057 | A1* | 1/2010 | Acres | G07F 17/32 463/26 |
| 2011/0183746 | A1* | 7/2011 | Englman | C08L 101/00 463/25 |
| 2011/0300919 | A1* | 12/2011 | Miyawaki | G07F 17/34 463/20 |
| 2013/0225268 | A1* | 8/2013 | Caputo | G07F 17/3237 463/25 |
| 2014/0087855 | A1* | 3/2014 | Caputo | G07F 17/326 463/26 |
| 2015/0080084 | A1* | 3/2015 | Saunders | G07F 17/34 463/20 |
| 2015/0206397 | A1* | 7/2015 | Nelson | G07F 17/3218 463/42 |
| 2016/0071358 | A1* | 3/2016 | Baerlocher | G07F 17/42 463/20 |
| 2016/0104344 | A1* | 4/2016 | Meyer | G07F 17/34 463/20 |

* cited by examiner

GAMING MACHINE AND METHOD HAVING BONUS GAME TRIGGER ADJUSTMENTS BASED ON SUPPLEMENTAL DATA

CROSS-REFERENCE TO RELATED APPLICATIONS

This application is a continuation of U.S. patent application Ser. No. 16/803,431 filed Feb. 27, 2020, entitled "Gaming Machine And Method Having Bonus Game Trigger Adjustments Based On Supplemental Data," which application is a continuation of U.S. patent application Ser. No. 15/881,618, filed Jan. 26, 2018, entitled "Gaming Machine And Method Having Bonus Game Trigger Adjustments Based On Supplemental Data," which application claims the benefit of U.S. Provisional Application No. 62/566,894 filed Oct. 2, 2017, entitled "Gaming Machine And Method Having Bonus Game Trigger Adjustments Based On Supplemental Data." Each of these prior applications is incorporated herein by this reference.

FIELD OF THE INVENTION

This invention relates gaming systems, and in particular to improvements in how bonus games are triggered in games.

BACKGROUND

Many different types of gaming machines have been developed to provide various formats and graphic presentations for conducting games and presenting game results. For example, numerous mechanical reel-type gaming machines, also known as slot machines, have been developed with different reel configurations, reel symbols, and paylines. More recently, gaming machines have been developed with video monitors that are used to produce simulations of mechanical spinning reels. These video-based gaming machines may use one or more video monitors to provide a wide variety of graphic effects in addition to simulated spinning reels, and may also provide secondary/bonus games using different reel arrangements or entirely different graphics. Many video-based gaming machines have three or five spinning reels that may be stopped to display a matrix of game symbols. The symbols displayed on the stopped reels correlate to a result of the game. Video-based gaming machines may also be used to show card games or various types of competitions such as simulated horse races in which wagers may be placed.

Bonus rounds or bonus games are used with slot machine games to increase the variability of prizes, the variability of game presentations, and player interest and excitement. The bonus games often provide a chance of larger credit prizes than those in the base game. Typically, the game math is designed to provide a designated probability of a particular bonus game being triggered in a base game round.

Game manufacturers are continuously pressed to develop new game presentations, formats, and game graphics in an attempt to provide high entertainment value for players and thereby attract and keep players. What is needed are ways to provide both anticipation and excitement to players while providing more variability in game results.

SUMMARY OF THE INVENTION

The present invention includes wagering games, gaming machines, networked gaming systems that provide improvements to feature games played on slot machines or other gaming machines. Methods and systems are disclosed providing slot machine games a capability of adjusting probabilities of triggering different bonus games based on non-random factors provided in supplemental data. Programming and data structure design are provided to implement a bonus trigger probability adjuster based on supplemental data input. Such data can include the state of a dynamic interactive game theme displayed at the gaming machine. Player inputs can alter the sequence of the theme display.

According to another aspect of the invention, a method of providing wagering game operated on a gaming machine employing the data structures and controller process, and awarding resulting prizes.

According to another aspect of the invention, a method of operating a gaming machine under control of a gaming machine electronic controller, the method including displaying a dynamic game theme display sequence including interactive graphical elements such as characters or animals moving, entering the display, and leaving the display. The method receives a player input and modifies the sequence of the dynamic game theme display. The dynamic game theme display state is reported to a bonus trigger probability modifier, which alters the probabilities of bonus triggers occurring in base game rounds on the gaming machine.

Another aspect of the invention is a computer program stored on a non-transitory readable medium. The software version is, of course, typically designed to be executed by a gaming machine or networked gaming system. The software includes multiple portions of computer executable code referred to as program code.

Another aspect of the invention is a gaming system that includes one or more gaming servers, and a group of electronic gaming machines connected to the servers by a network, programmed to provide one of more of the methods described herein. The various functionality described herein may be distributed between the electronic gaming machines and the gaming servers in any practically functional way. For example, the current preferred architecture is for the servers to determine all aspects of game logic, random number generation, and prize awards. The gaming machines provide functionality of interfacing with the player and animating the game results to present the results received from the server in an entertaining manner. However, other embodiments of course might use a thin client architecture in which the animation is also conducted by the server and electronic gaming machines serve merely as a terminal to receive button or touchscreen input from the player and to display graphics received from the server.

Different features may be included in different versions of the invention. These and other advantages and features of the invention will be apparent from the following description of the preferred embodiments, considered along with the accompanying drawings.

DETAILED DESCRIPTION OF EXAMPLE EMBODIMENTS

Various embodiments of the present invention allow the probabilities associated with a bonus triggering to be manipulated by non-random forces. Typically slot game bonuses have pre-determined hit rates and simply use a random probability to determine if a bonus should be played or not. The systems and methods herein allows supplemental data to be supplied to the slot game math and to be used in determining if a bonus should be played.

For example, if a game has a dynamic scene where actors are moving in/out of view, the presence of a given actor could influence which bonus is triggered. One specific example is in the game titled Shark Week by Everi Games, Inc. This game has a fish tank scene where fish/sharks and bonus items such as a wheel move in/out of view over time. When the player places a bet and initiates a play, the "world state" is sent to the math processer and it uses this state to determine which bonus should be initiated. If a shark is present on screen, the shark bonus might be initiated. If a wheel is on screen, the wheel bonus might be initiated. If three small fish are on screen, a small fish bonus might be initiated. The basis of the adjustment is that the math does not solely rely on random probabilities to determine if a bonus will be triggered. Instead, it uses this understanding of the "world state," a set of supplemental data, to choose a bonus and presentation accordingly.

Figure 2:
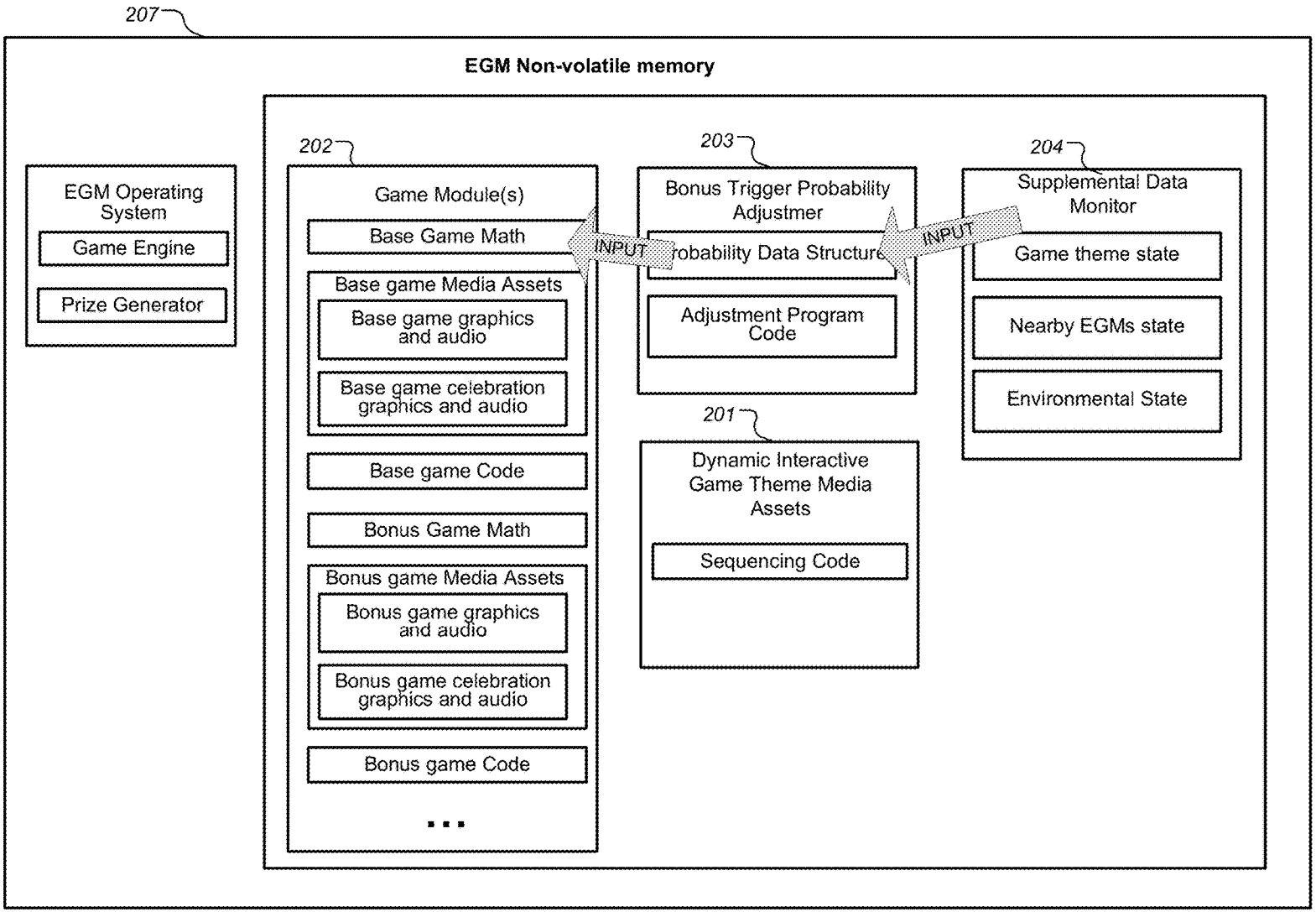
FIG. 2 is a block diagram of program code and data structures according to an example embodiment.

An example of data which can be used for such supplemental data can be seen in the block diagram of FIG. 2, which shows software and data structure modules for an electronic gaming machine (EGM) memory. As seen in the diagram, the EGM non-volatile memory holds software and data structures to be loaded in RAM for use in providing wagering games. The EGM typically includes a game engine program that executes or triggers code from the depicted game modules 202, such as scripts, to perform and display games from one or more game modules 202. A prize generator provides randomly selected prize amounts or random numbers employed in the games to determine the outcome. The game modules 202 may include separate modules for base games and bonus games, or may include a single module for each game title available to be played on the machine. A game module, as shown in the depicted example, includes game math, game media assets, and game code. The game math the probabilities and rules needed to create the desired mathematical profile of game outcomes, including credit prizes and bonus game triggers. The game media assets include the graphics, video, and audio necessary to create the presentation of the game. The game code includes program code such as scripts to provide the sequencing of the game presentation and processing user inputs in the game.

A bonus trigger probability adjuster 203 is also stored in the EGM memory, including a probability data structure which contains variables that are provided as an input to the game math when the game is executed to make the adjustments to the various probabilities for triggering different bonus games. The variables may store the affected probabilities directly, or may store related data such as scaling or other data depending on the specific design of the game math. Adjuster 203 also includes adjustment program code, which may be scripts such as javascript or binary executable code, to implement rules and logic needed to change the variables in the probability data structure. Additionally, the use of game theme state data in supplemental state data monitor 204 provides for another aspect of this invention, to allow the player to interact with the actors of a scene to manipulate them into staying visible for longer, effectively increasing the probability that a bonus will trigger. In the example above, a shark on screen increases the probability that a shark bonus will trigger. If the player interacts with the shark by touching the screen, or activating inputs that cause feeding the shark, etc, the interaction has a direct effect on the shark's behavior and ultimately increase the frequency by which the shark bonus is played. Ultimately, this gives the player the impression that they can have an impact on the results of a game and increases the interest and excitement of playing the game.

The adjuster 203 receives as input various supplemental data supplied by a supplemental data monitor 204, which includes program code such as scripting or executable code for obtaining the supplemental data from various sources. Various kinds of supplemental data can be provided to the process to adjust the logic for triggering bonuses including: Environmental state data concerning factors such as weather, date, time of day, and location; game theme state data provides data of a dynamic game theme provided on one or more of the gaming machine displays for entertainment (A dynamic game theme includes animations or video that vary over time, such as fish swimming in/out, farm animals walking around, birds flying in/out, etc.); Player interaction with the dynamic game theme environment effecting which actors stay/go and for how long; and the nearby EGM state data provides information concerning the state of other nearby EGMS such as those in a common group with the present machine, or those sharing a common overhead display (for example, if one machine is playing a certain bonus type, the present machine may be adjusted to be more likely or be less likely to trigger the same bonus).

Supplemental data preferably is not able to be directly modified by a player. That is, menus and other inputs provide a game player no ability to directly alter the supplemental data that feeds into the bonus trigger probability adjuster. Player activity may, however, indirectly affect the supplemental data such as by interacting with a dynamic graphical theme and causing modifications to the theme.

Figure 1:
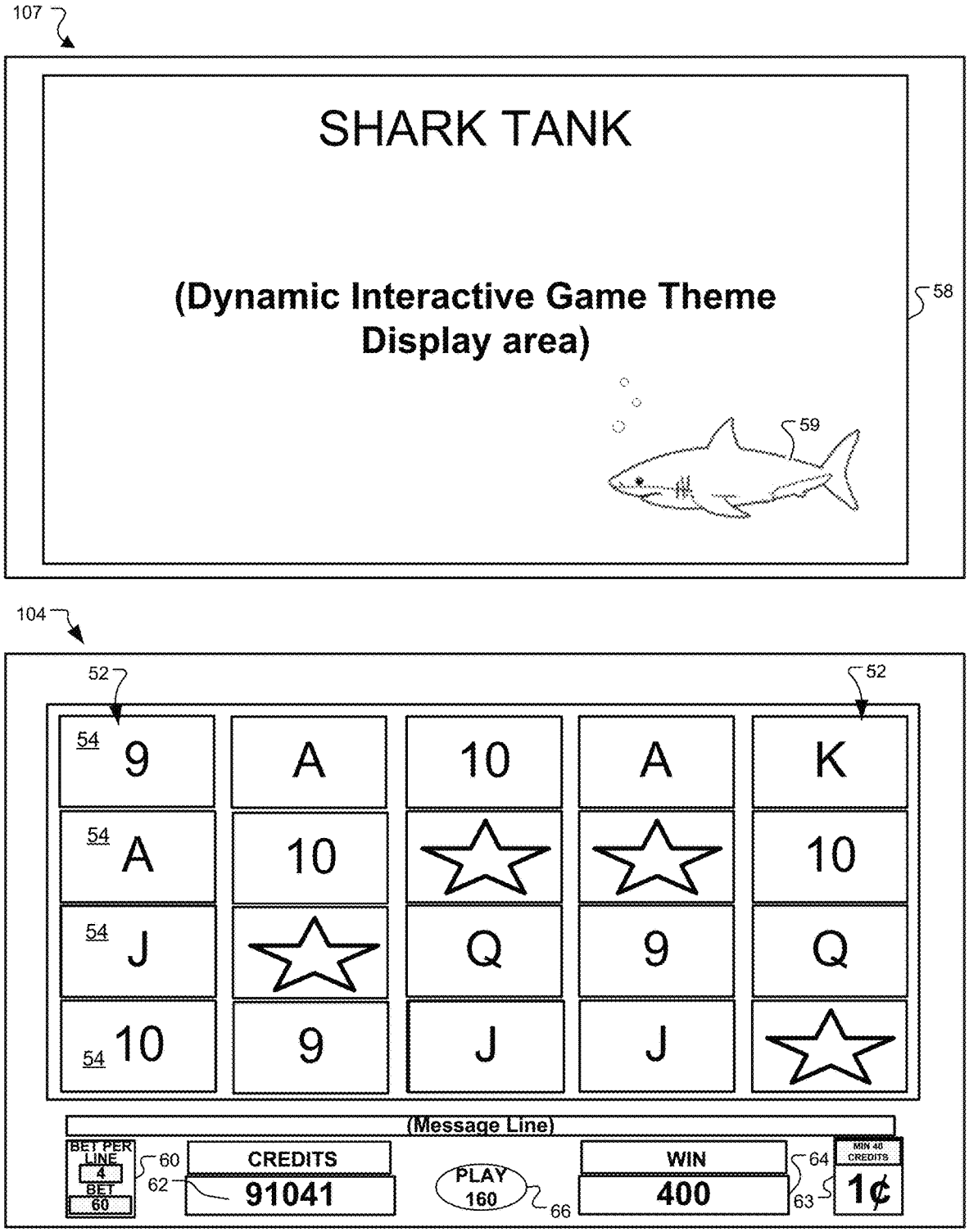
FIG. 1 is a game screen diagram showing a base game mode and an interactive game theme display area according to an example embodiment.

FIG. 1 is a game screen diagram illustrating a base game mode showing the primary display 104 and secondary (top) display 107 to illustrate an example slot machine display arrangement on which wagering game results are presented in a gaming area, typically found on the primary display. The secondary display 107 includes a dynamic interactive game theme display area 58, including at least one interactive graphic element such as the depicted animated shark character 59, which may be depicted in a 'shark tank' view showing water and other interactive graphic elements and passive graphic elements, the functioning of which is further described below. On primary display 104, the gaming area of a reel-type primary game (as opposed to bonus games or other feature games as described herein) in this version is a matrix 51 of symbol locations arranged in rows and columns to represent simulated slot machine reels that are spun to conduct a game round. Other embodiments may, of course, use other types of game displays to display randomizing of symbols according to the methods herein. The depicted columns of symbols labeled 52 represent the simulated reels, while symbols are shown in each symbol location designated 54. In this instance there are five reels with four symbol locations 54 displayed at a time on each reel, but the game can be played with more and less reels. The simulated reel typically has far more symbols than those displayed, and as many unique stop positions as there are symbols on the simulated reel. The stop position may be counted, for example, by numbering the symbols on the simulated reel and using the number of the symbol at the bottom of the display window (the three symbols displayed in this example), or at the top or middle. Further, while multi-symbol reels are shown, other versions may use simulated uni-symbol reels, or a reel that has many symbols thereon but only a single window to the reel simulated, displaying a single symbol from the reel. Some variations of the present invention may use a simulated uni-symbol reel in each depicted symbol location 54. Winning patterns are typically formed by matching symbols along defined paylines that pass through the matrix 51.

Below matrix 51 is box 60, which displays the current wager and amount bet per payline. Other versions may not have a designated bet per line. To the right of box 60 is box 62, which displays the current credits in the player's account. In the bottom center a touchscreen play button 66 is presented in the lower central area of the display, which may show other game state related graphics. Right of this is win box 64, which displays the player's last awarded winnings. The wager credit denomination is shown in box 63. Along the bottom edge of the matrix 51 there is a message line, where the game station can display further instructions to the player.

Figure 3:
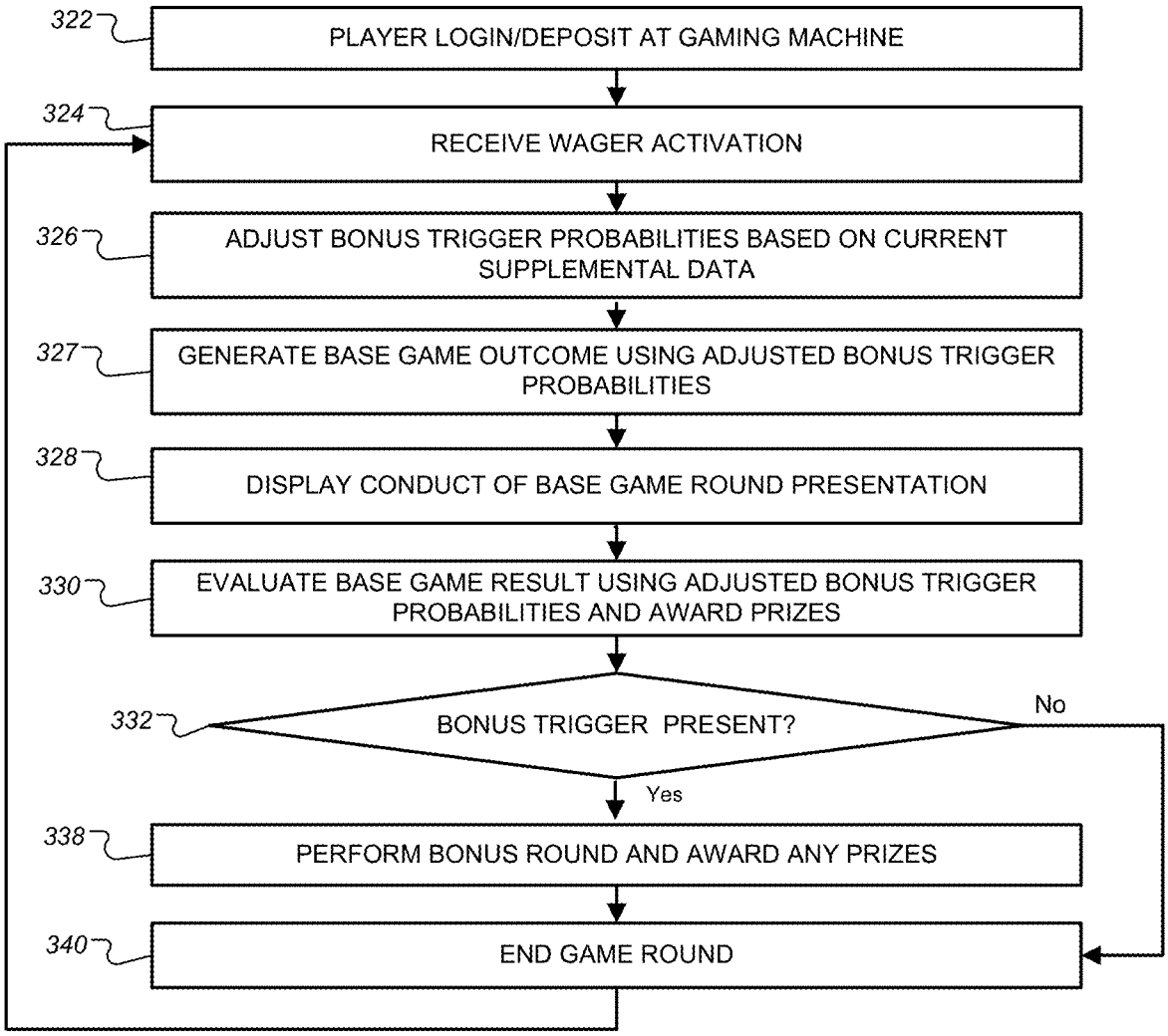
FIG. 3 is a flowchart of a process for providing a base game and bonus game according to an example embodiment.

FIG. 3 is a flowchart showing a process for providing a wagering game base game according to one or more embodiments of the invention. Generally, the process is conducted under control of one or more electronic processors to present gaming results on one or more displays on a gaming machine such as those described below. To initialize the game and make it available for wagering, the process starts a game engine software package for executing the game, and provides several data structures which are manipulated to conduct the game, including: a first data structure stored in a memory of the gaming machine comprising data corresponding the base game presentation, and additional data structures described with respect to FIG. 2 for use in presenting various bonus games.

The process of providing a wagering game for a player starts at block 322 where a player logs in or deposits money or a credit voucher at a gaming machine. This includes receiving the player deposit through a credit input device such as the bill/voucher acceptor 112 (FIG. 5), and in response activating a credit meter value that establishes a player credit balance from which wagers may be made during the gaming process.

To begin a game play, the method receives a wager activation on a player input device at the gaming machine at block 324, which typically consists of some input from the player to set the amount to be wagered from their credit balance on the credit meter. The wager amount may also be carried over from previous game rounds by simply starting the game with the previous wager amount set. This typically happens through a 'Play' button (110, FIG. 5) on the game cabinet or touchscreen display, and serves to place the wager and start a single round of game play in the base game at block 328. Next at block 326, the process adjusts the bonus trigger probabilities based on current values of designated supplemental data as discussed above. The adjustment is preferably done by bonus trigger probability adjuster program code 203, which modifies designated variables that are used in the game math process to provide the probability of a bonus trigger when creating the base game outcome. The adjustment may increase a probability of a single designated bonus trigger associated with a particular bonus game, while decreasing the probability of other bonus triggers. For example, in some versions, the presence of a particular interactive graphical element on the gaming machines dynamic interactive game theme display is the supplemental data that causes a bonus game associated with the particular interactive graphical element to have an increased probability of triggering. Or the adjustment may decrease the probability of designated bonus triggers occurring. At block 327, process employs the adjusted probabilities in the game math when generating the base game outcome responsive to the wager. For games in which a 'true-spin' or 'reels first' game logic is used, the generation of an outcome involves generating reel stops using the adjusted probabilities. For games in which a 'prize first' or 'reverse mapped' game logic is use, block 327 generates such a prize using the adjusted game math. In some games, the game outcome may provide that a bonus win occurs with a designated prize, but not specify which bonus game presentation is to be used, that is which bonus game will trigger. In such case, the game engine selects a presentation including a bonus game trigger selected according to the adjusted probabilities for the bonus triggers.

The base game outcome is displayed at block 328. In embodiments having reels, reel displays, or simulated reels, the base game round is conducted by spinning and stopping the reels. Other embodiments may otherwise rearrange or randomize the symbols on the matrix in any suitable manner. For games that use other methods of scrambling the matrix besides simulated reels, the random outcome is determined at this step as appropriate for the game. The base game outcome includes a possibility of winning money value credits and a possibility of winning a bonus game outcome. The game outcome is evaluated at block 330 by checking the symbols on the matrix for winning patterns and other winning symbols or combinations thereof. Preferably, prizes for winning patterns in the base game outcome are awarded at this block. Block 330 may include applying the adjusted probabilities for bonus game triggers, depending on when the bonus game trigger is provided, as discussed above. If a bonus trigger is present in the outcome at block 332, the process goes to block 338 where the triggered bonus game round is performed and any prizes awarded in the bonus game round. More than one bonus game round may be triggered in some versions. After the bonus game presentation, the process at block 340 ends the game round responsive to the wager and returns to block 324 to wait for the next player wager.

Figure 4:
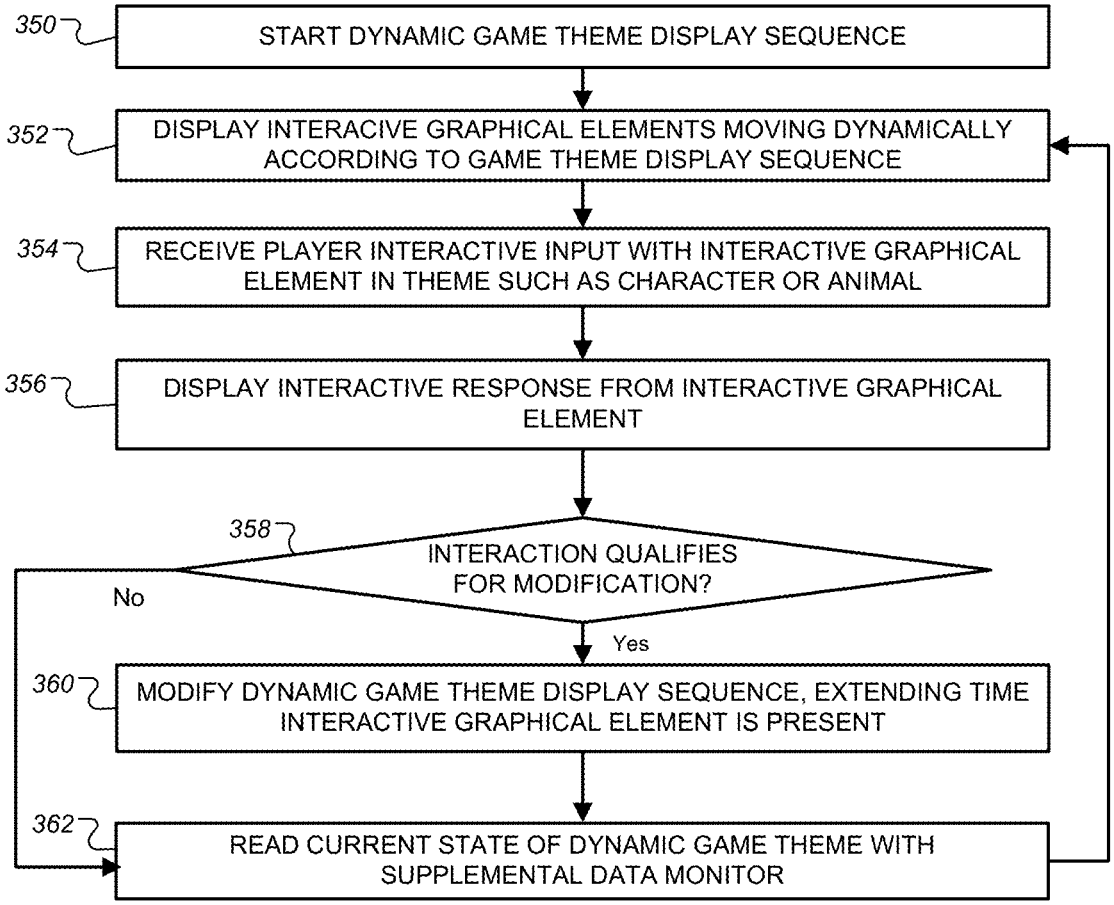
FIG. 4 is a flowchart of a process for providing a dynamic interactive game theme according to an example embodiment.

FIG. 4 is a flowchart of a process for providing a dynamic interactive game theme according to an example embodiment. The process starts at block 350 where the gaming machine starts a dynamic game theme display sequence, which is displayed at least in display area 58 on the secondary display 107. The sequence may include graphics surrounding or superimposed on the gaming matrix 51 of primary display 104, and may also include graphic sequences on an overhead group display (413, FIG. 7) associated with multiple gaming machines in a group. The sequence displayed at block 352, which may happen both while a player is playing on the gaming machine and as an 'attract' sequence when no player is logged in. The sequence typically includes an animate sequence based on a set of dynamic interactive game theme media assets (201, FIG. 2) which may be stored on the gaming machine and on a group display server controlling the group display. The sequence may include a fixed scenario of animated graphic elements appearing on the displays and performing various animated actions, or the timing and actions may include randomization such as the particular selection of characters, actions, and timing being selected among available options in the media assets 201 based on random number selection. Typically the dynamic game theme display sequence includes interactive graphical elements representing characters or animals moving, entering the display, and leaving the display. The sequence may also include characters, animals, or other graphic elements being portrayed to move on an overhead group display and move onto the secondary display 107, and to move from secondary display 107 to the overhead group display.

While the sequence is being displayed, the process at block 354 receives a player interactive input with a first one of the interactive graphical element. The interactive input may be in a variety of ways, such as by touching the graphical element on a touchscreen, touching other elements of the interactive theme in ways that cause them to interact with the interactive element (usually a character or animal), or activating player controls labeled to provide interactions with the theme graphical elements. For example, an interaction with a designated element may involve touching the shark character 59 (FIG. 1), causing it to be fed. Or touching or dragging other items to the shark character, causing it to eat them. The interaction may include dragging the character, animal, or another graphic element to another place on the display. For example, dragging a character toward the bottom of the secondary display may make it less likely to leave the display. Many types of interaction are known with touchscreen interactive elements and may be used with the interactive graphic elements in the dynamic interactive game theme. Typically certain interactions are only allowed if a player has deposited credits to play. The player interactive input is preferably independent of gaming inputs such as wager settings and wager activations, although the process may include allowing more interactions of different types the longer a player plays, or allowing more interactions of different types if the player wagers at a higher level. At block 356, the process includes displaying the interactive response to the player interaction, such as the shark character eating something, or a character smiling, talking, moving, or otherwise responding to the player input.

Next at block 358, the process includes determining if the interaction qualifies for a modification (beyond showing the interactive response at block 356). If so, the process goes to block 360 where it modifies the dynamic game theme display sequence. For example, it may extend the time that the first character or animal interactive element is present on the display. Certain actions may cause a character or other element to leave the display. The modification at block 360 preferably modifies at least one variable in a theme sequencing code, such as a script in media assets 201, to implement the change. Then at block 362 the process includes providing the current state of the dynamic game theme to the supplemental data monitor. This has the effect of altering the probability of at least one bonus round presentation in a wagering game based on the current state of the dynamic game theme.

Referring to FIG. 3 and FIG. 4, the process functionality is controlled by the system processor by executing program code, executable by a gaming machine or gaming network processor, to accomplish the functionality as described herein. It should be understood that this is only one example embodiment, and other versions may divide the processing tasks of the game method in a different manner. For example, some systems may employ a thin client architecture in which practically all of the processing tasks are performed at the game server, and only display information for the player interface transmitted to the electronic gaming machine. In such an embodiment, only the steps involving player input or display are performed by the electronic gaming machine, with the remaining steps performed by one of the game servers in the system. In such a case, though, the software architecture is preferably designed as a thin client in which a dedicated virtual machine running on the game server (or a virtual machine server connected in the gaming network) performs the tasks designated in the present drawing as occurring "at the gaming machine." In the depicted flowcharts, the method is performed by the respective computer hardware operating under control of computer program code. While central processor arrangements may vary (for example award controllers may be integrated on the same machine with a gaming server, or may be a separate server connected on a secure network), the particular central determinant architecture is not limiting and will be referred to generally in this drawing as the game server (403). To complete the base game and bonus game of FIG. 3 and FIG. 4, the thin client version of the process, performed at the game server, further includes receiving game play requests originating from electronic gaming machine 100, and sending commands to the gaming machine to show reels spinning, the graphical accumulation object, the bonus round selection process, and results being displayed. The division of game logic steps between gaming machines and servers is known in the art and may be accomplished according to suitable methods allowed for the relevant gaming jurisdictions.

Figure 5:
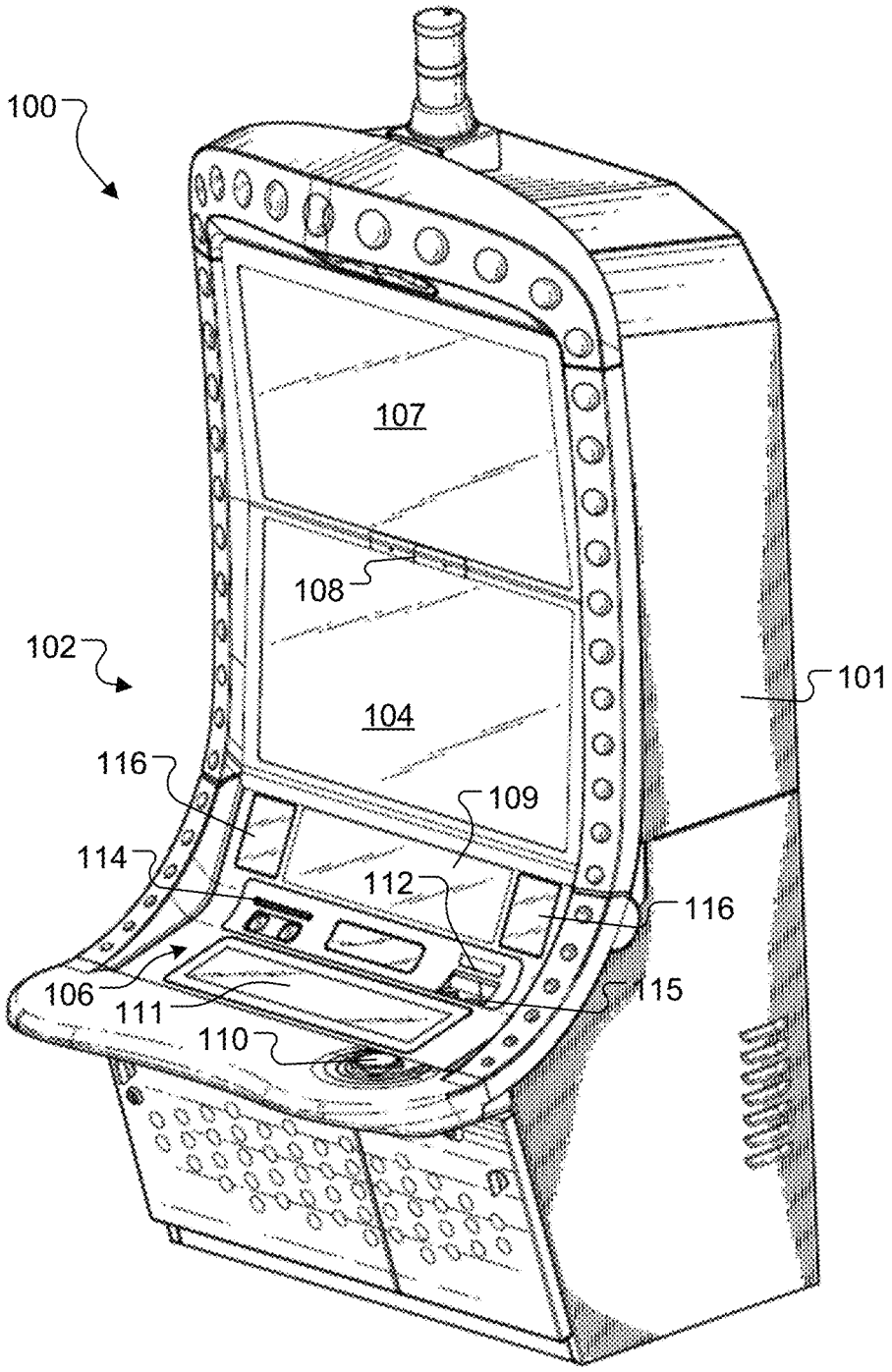
FIG. 5 is a front perspective view of a gaming machine which may be used in a gaming system of the present invention.
Figure 6:
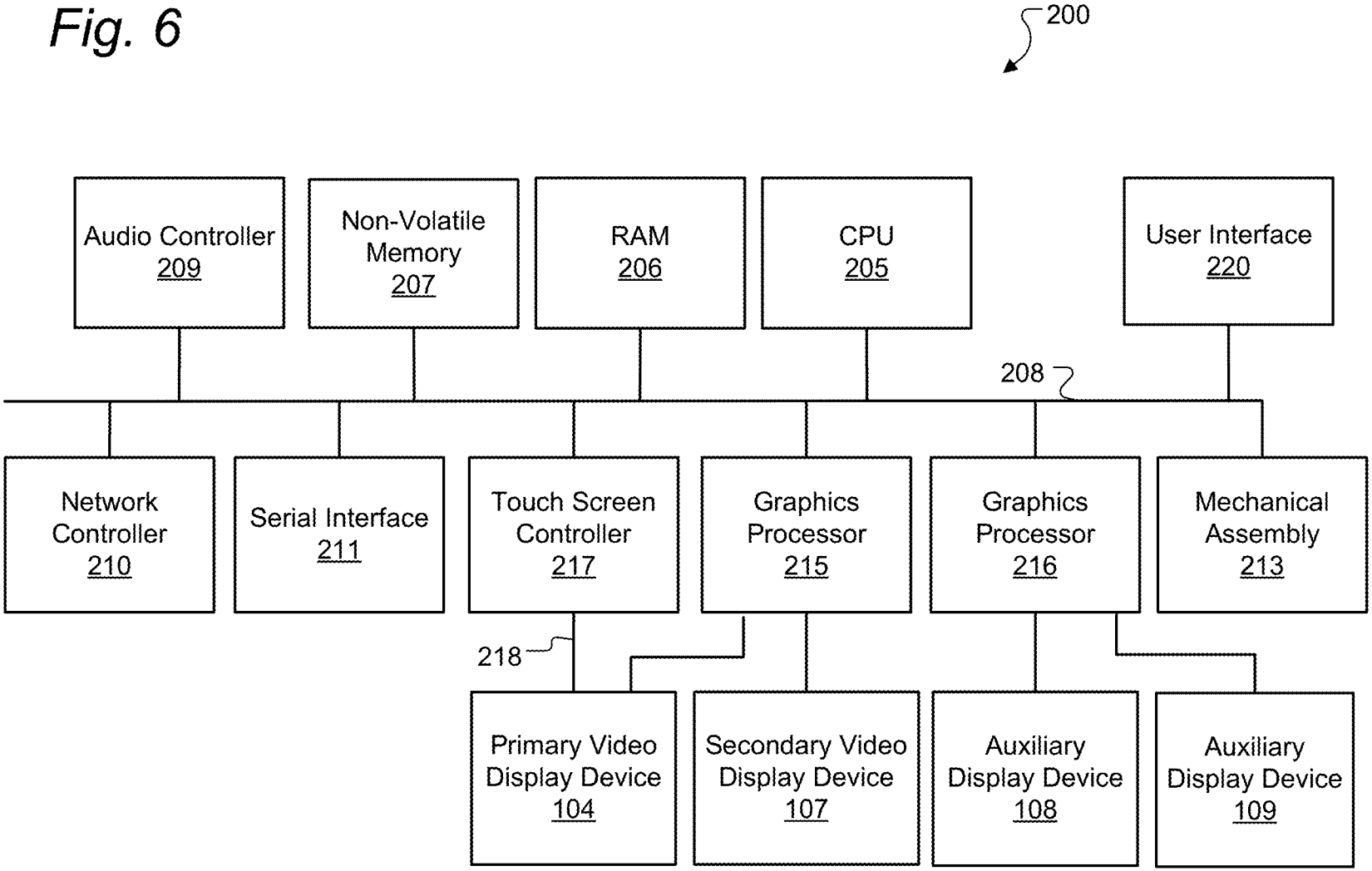
FIG. 6 is a block diagram showing various electronic components of the gaming machine shown in FIG. 5 together with additional gaming system components.

FIG. 5 shows a gaming machine 100 that may be used to implement feature games according to the present invention. The block diagram of FIG. 6 shows further details of gaming machine 100. Referring to FIG. 5, gaming machine 100 includes a cabinet 101 having a front side generally shown at reference numeral 102. A primary video display device 104 is mounted in a central portion of the front surface 102, with a ledge 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. All of the displays may include touchscreen sensors, especially display 109 which may be used to present touchscreen controls for wagering. It should also be noted that each display device referenced herein may include any suitable display device including a cathode ray tube, liquid crystal display, plasma display, LED display, or any other type of display device currently known or that may be developed in the future.

In preferred versions, the gaming machine 100 illustrated in FIG. 5 also includes a number of mechanical control buttons 110 mounted on ledge 106. These control buttons 110 may allow a player to select a bet level, select paylines, select a type of game or game feature, and actually start a play in a primary game. Further, primary video display device 104 in gaming machine 100 provides a convenient display device for implementing touchscreen controls as does touchscreen 111 mounted on ledge 106.

A player input system of gaming machine 100 may also include a number of other player interface devices for use in playing a particular game. The ledge 106 may also include buttons, touch sensors, or switches, joysticks, or other mechanical input devices, and/or virtual buttons and other controls implemented on a suitable touchscreen video display. Gaming machine 100 also includes a currency/voucher acceptor having an input ramp 112, a player card reader having a player card input 114, and a voucher/receipt printer having a voucher/receipt output 115. One or more of these devices provides a credit input device in communication with the controller and adapted for accepting a physical item associated with a monetary value that establishes a player credit balance. Audio speakers 116 generate an audio output to enhance the user's playing experience.

FIG. 6 shows a logical and hardware block diagram 200 of gaming machine 100 which includes a central processing unit (CPU) 205 along with random access memory 206 and nonvolatile memory or storage device 207. Storage device 207 is a tangible, nontransitory (nonvolatile) memory holding the program code for presenting the game results as described herein, including a base game data structures 230 containing the data structures associated with the base game round as described above, and bonus game data structures 232 containing the data structures for implementing the bonus game. All of these devices are connected on a system bus 208 with an audio controller 209, a network controller 210, and a serial interface 211. A graphics processor 215 is also connected on bus 208 and is connected to drive primary video display device 104 and secondary video display device 107 (both mounted on cabinet 101 as shown in FIG. 5). A second graphics processor 216 is also connected on bus 208 in this example to drive the auxiliary display devices 108 and 109 also shown in FIG. 5. As shown in FIG. 6, gaming machine 100 also includes a touch screen controller 217 connected to system bus 208. Touch screen controller 217 is also connected via signal path 218 to receive signals from a touchscreen element associated with primary video display device 104 and secondary display device 107. Auxiliary display device 109 may also include an integrated touchscreen controller. It will be appreciated that the touchscreen element itself typically comprises a thin film that is secured over the display surface of primary video display device 104. The touchscreen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 6 are elements commonly associated with a computer system architecture. These elements are preferably mounted on a chassis and is itself mounted in cabinet 101 shown in FIG. 5. Alternatively, the various electronic components may be mounted on one or more circuit boards housed within cabinet 101 without a separate enclosure such as those found in personal computers. Those familiar with data processing systems and the various data processing elements shown in FIG. 6 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 6 as being connected directly on system bus 208 may in fact communicate with the other system components through a suitable expansion bus. Audio controller 209, for example, may be connected to the system via a PCI bus. System bus 208 is shown in FIG. 6 merely to indicate that the various components are connected in some fashion for communication with CPU 205 and is not intended to limit the invention to any particular bus architecture. Numerous other variations in the gaming machine internal structure and system may be used without departing from the principles of the present invention.

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, it will be appreciated that CPU 205 may control all of the display devices directly without any intermediate graphics processor. The invention is not limited to any particular arrangement of processing devices for controlling the video display device included with gaming machine 100. Also, a gaming machine implementing the present invention is not limited to any particular number of video display devices or other types of display devices.

In the illustrated gaming machine 100, CPU 205 executes software which ultimately controls the entire gaming machine including the receipt of player inputs and the presentation of the graphic symbols displayed according to the invention through the display devices 104, 107, 108, and 109 associated with the gaming machine. As will be discussed further below, CPU 205 either alone or in combination with graphics processor 215 may implement a presentation controller for performing functions associated with a primary game and bonus game that may be available through the gaming machine, and the dynamic interactive game theme. In some versions, a separate controller and graphics processor, which may be in a networked server, controls the dynamic interactive game theme display on all machines. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs, while the nonvolatile memory or storage device 207 may comprise a hard drive, flash drive, or other mass storage device providing storage for programs not in use or for other data generated or used in the course of gaming machine operation. Network controller 210 provides an interface to other components of a gaming system in which gaming machine 100 is included.

It should be noted that the invention is not limited to gaming machines employing the computer-type arrangement of processing devices and interfaces shown in example gaming machine 100. Other gaming machines through which the features herein are implemented may include one or more special purpose processing devices to perform the various processing steps for implementing the present invention, such as generating random numbers or checking the security status of software packages or gaming credit vouchers. Unlike general purpose processing devices such as CPU 205, these special purpose processing devices may not employ operational program code to direct the various processing steps.

It should also be noted that the invention is not limited to gaming machines including only video display devices for conveying results. It is possible to implement a feature game within the scope of the present invention using an electro mechanical arrangement or even a purely mechanical arrangement for displaying the symbols or first and second animations or reactions needed to complete the graphical interactions as described herein.

Still referring to the hardware and logical block diagram 200 showing an example design for a gaming machine 100, the depicted machine in operation is controlled generally by CPU 205 which stores operating programs and data in memory 207 with wagering game, user interface 220, network controller 210, audio/visual controllers, and reel assembly 213 (if mechanical reel configuration). CPU or game processor 205 may comprise a conventional microprocessor, such as an Intel microprocessor, mounted on a printed circuit board with supporting ports, drivers, memory, software, and firmware to communicate with and control gaming machine operations, such as through the execution of coding stored in memory 207 including one or more wagering games and supplemental data monitor program code and related data structures. Game processor 205 connects to user interface 220, which may include any or all of the player input devices described above in connection with FIG. 5, such that a player may enter input information, and game processor 205 may respond according to its programming, such as to apply a wager and initiate execution of a game. Game processor 205 also may connect through network controller 210 to a gaming network, such as example casino server network 400 shown in FIG. 7.

Figure 7:
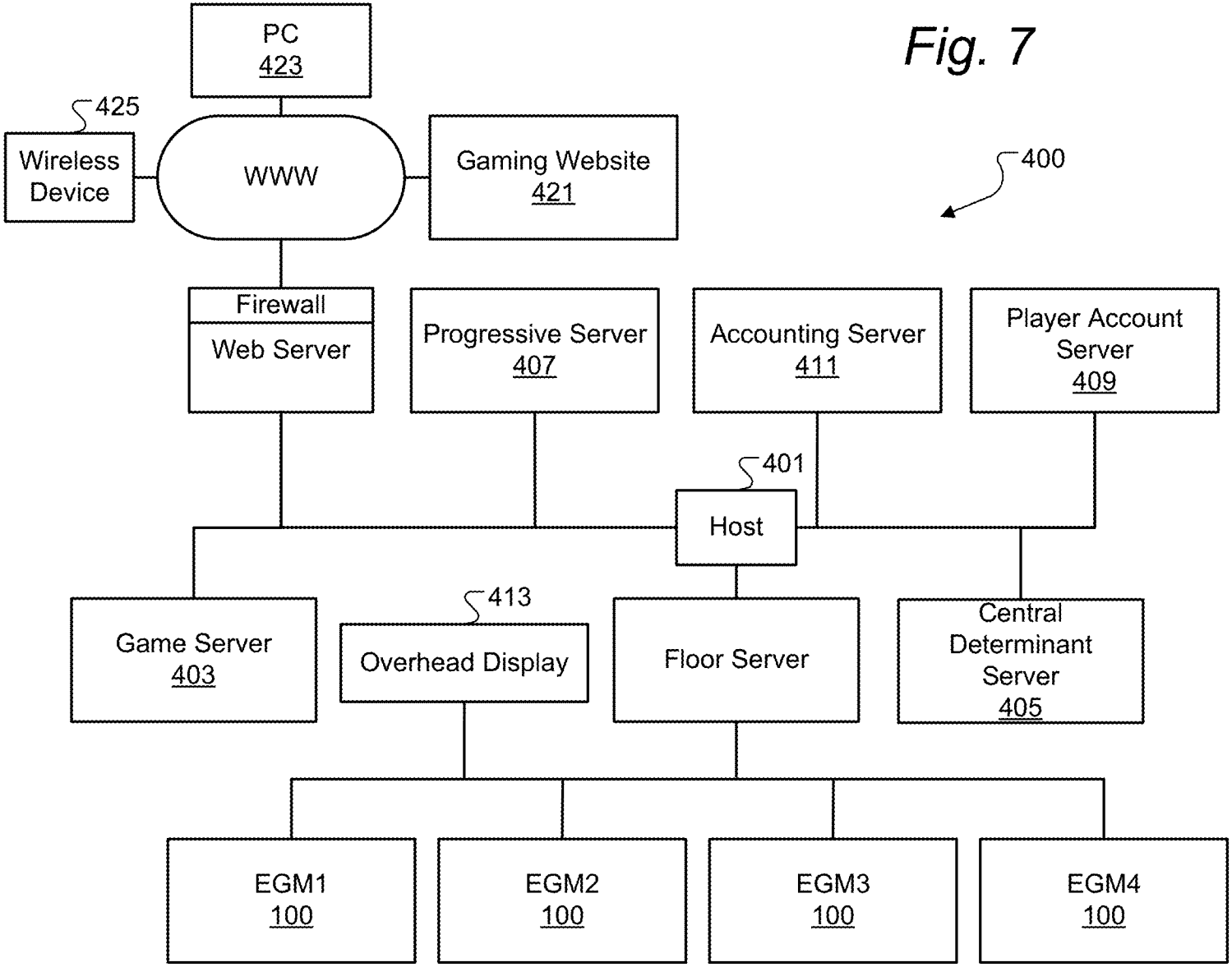
FIG. 7 is a system block diagram of a gaming system according to one embodiment of the present invention.

Referring now to FIG. 7, the casino server network 400 may be implemented over one or more site locations and include host server 401, remote game play server 403 (which may be configured to provide game processor functionality including determining game outcomes and providing audio/visual instructions to a remote gaming device), central determinant server 405 (which may be configured to provide random numbers to gaming processes, or to determine lottery, bingo, or other centrally determined game outcomes and provide the information to networked gaming machines 100 providing lottery and bingo-based wagering games to patrons), progressive server 407 (which may be configured to accumulate a progressive pool from a portion of wagering proceeds or operator marketing funds and to award progressive awards upon the occurrence of a progressive award winning event to one or more networked gaming machines 100), player account server 409 (which may be configured to collect and store player information and/or awards and to provide player information to gaming machines 100 after receiving player identification information such as from a player card), and accounting server 411 (which may be configured to receive and store data from networked gaming machines 100 and to use the data to provide reports and analyses to an operator). Through its network connection, gaming machine 100 may be monitored by an operator through one or more servers such as to assure proper operation, and, data and information may be shared between gaming machine 100 and respective of the servers in the network such as to accumulate or provide player promotional value, to provide server-based games, or to pay server-based awards. As depicted in FIG. 7, a block diagram of an example networked gaming system 400 may be associated with one or more gaming facilities, including one or more networked gaming machines 100 in accordance with various embodiments. With reference to FIG. 7, while a few servers have been shown separately, they may be combined or split into additional servers having additional capabilities.

As shown, networked gaming machines 100 (EGM1-EGM4) and one or more overhead displays 413 may be network connected and enable the content of one or more displays of gaming machines 100 to be mirrored or replayed on an overhead display, or a graphic and audio sequence is shown for announcing and celebrating that a large value win has occurred, known as "celebration" sequence. For example, the primary display content may be stored by the display controller or game processor 205 and transmitted through network controller 210 to the overhead display controller either substantially simultaneously or at a subsequent time according to either periodic programming executed by game processor 205 or a triggering event, such as a jackpot or large win, at a respective gaming machine 100. In the event that gaming machines 100 have cameras installed, the respective player's video images may be displayed on overhead display 413 along with the content of the player's gaming machine 100 and any associated audio feed.

In one or more embodiments, game server 403 may provide server-based games and/or game services to network connected gaming devices, such as gaming machines 100 (which may be connected by network cable or wirelessly). Progressive server 407 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Accounting server 411 may receive gaming data from each of the networked gaming devices, perform audit functions, and provide data for analysis programs, such as the IGT Mariposa program bundle.

Player account server 409 may maintain player account records, and store persistent player data such as accumulated player points and/or player preferences (e.g. game personalizing selections or options). For example, the player tracking display may be programmed to display a player menu that may include a choice of personalized gaming selections that may be applied to a gaming machine 100 being played by the player.

In one or more embodiments, the player menu may be programmed to display after a player inserts a player card into the card reader. When the card reader is inserted, an identification may be read from the card and transmitted to player account server 409. In some systems, the player card constitutes a physical object which may be read by the gaming machine 100 to deposit credits to the gaming machine for playing, although typically such credits are provided through currency or credit vouchers. Player account server 409 transmits player information through network controller 210 to user interface 220 for display on the player tracking display. The player tracking display may provide a personalized welcome to the player, the player's current player points, and any additional personalized data. If the player has not previously made a selection, then this information may or may not be displayed. Once the player makes a personalizing selection, the information may be transmitted to game processor 205 for storing and use during the player's game play. Also, the player's selection may be transmitted to player account server 409 where it may be stored in association with the player's account for transmission to the player in future gaming sessions. The player may change selections at any time using the player tracking display (which may be touch sensitive or have player-selectable buttons associated with the various display selections).

In one or more embodiments, a gaming website may be accessible by players, e.g. gaming website 421, whereon one or more games may be displayed as described herein and played by a player such as through the use of personal computer 423 or handheld wireless device 425 (e.g. Apple iPhone, Android phone, tablet, phablet, virtual reality device, iPad, etc.). To enter the website, a player may log in with a username (that may be associated with the player's account information stored on player account server 409 or be accessible by a casino operator to obtain player data and provide promotional offers), play various games on the website, make various personalizing selections and save the information, so that during a next gaming session at a casino establishment, the player's playing data and personalized information may be associated with the player's account and accessible at the player's selected gaming machine 100.

Referring generally to the description herein, any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any relevant foreign patent laws, for any working combination or some sub-combination of the features herein.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A gaming machine comprising:

(a) a display system including a video display;

(b) a player input system;

(c) a controller operatively coupled to control the display system, and operatively coupled to the player input system, wherein the controller is programmed to:

cause the video display to display a time-varying game theme display sequence including one or more interactive graphical elements;

based at least in part on a player input received through the player input system, change a state of the time-varying game theme display sequence;

associated with changing the state of the time-varying game theme display sequence, adjust a bonus trigger probability data structure to change a probability of at least one of multiple bonus games being triggered in an instance of a game at the gaming machine and thereby place the bonus trigger probability data structure in a modified state in which at least two of the multiple bonus games each have a respective non-zero probability of being triggered in a respective instance of the game after the adjustment to the bonus trigger probability data structure; and in response to a game activation input received through the player input system while the bonus trigger probability data structure is in the modified state, (i) conduct a respective instance of the game to cause a game outcome to be displayed through the display system, (ii) apply the respective probability of each of the at least two of the multiple bonus games to select one of the at least two of the multiple bonus games, and (iii) activate the selected one of the at least two of the multiple bonus games at the gaming machine.

2. The gaming machine of claim 1 in which the time-varying game theme display includes an animated character or animal and in which the change in the state of the time-varying game theme display sequence comprises a visible reaction by the animated character or animal.

3. The gaming machine of claim 1 in which the time-varying game theme display sequence includes a graphical element that appears in and leaves the time-varying game theme display sequence, and in which the player input has an effect of extending a time during which the graphical element appears in the time-varying game theme display sequence.

4. The gaming machine of claim 1 in which the adjustment to the bonus trigger probability data structure is further based on supplemental data regarding a state of a time-varying game theme display sequence displayed at an additional gaming machine.

5. The gaming machine of claim 1 in which the adjustment to the bonus trigger probability data structure is further based on supplemental data comprising environmental state data.

6. The gaming machine of claim 1 in which the adjustment to the bonus trigger probability data structure is further based on supplemental data not directly adjustable by a player.

7. The gaming machine of claim 1 in which the player input comprises a player touch of a selected graphical element of the time-varying game theme display sequence.

8. A method performed under control of a gaming machine electronic controller, the method comprising:

(a) displaying on a video display a time-varying game theme display sequence including one or more interactive graphical elements;

(b) receiving a player input at a gaming machine, and based thereon, changing a state of the time-varying game theme display sequence;

(c) associated with changing the state of the time-varying game theme display, adjusting a bonus trigger probability data structure to change a probability of at least one of multiple bonus games being triggered in an instance of a game at the gaming machine and thereby place the bonus trigger probability data structure in a modified state in which at least two of the multiple bonus games each have a respective non-zero probability of being triggered in a respective instance of the game after the adjustment; and (d) in response to a game activation input at the gaming machine while the bonus trigger probability data structure is in the modified state, (i) conducting a respective instance of the game to cause a game outcome to be displayed through a display system of the gaming machine, and (ii) applying the respective probability of each of the at least two of the multiple bonus games to select one of the at least two of the multiple bonus games, and (iii) activating the selected one of the at least two of the multiple bonus games at the gaming machine.

9. The method of claim 8 in which the time-varying game theme display includes an animated character or animal and in which the change in the state of the time-varying game theme display sequence comprises a visible reaction by the animated character or animal.

10. The method of claim 8 in which the time-varying game theme display sequence includes a graphical element that appears in and leaves the time-varying game theme display sequence, and in which the player input has an effect of extending a time during which the graphical element appears in the time-varying game theme display sequence.

11. The method of claim 8 in which adjusting the bonus trigger probability data structure is further based on supplemental data regarding a state of a time-varying game theme display sequence displayed at an additional gaming machine.

12. The method of claim 8 in which adjusting the bonus trigger probability data structure is further based on supplemental data regarding a state of a time-varying game theme display sequence displayed at an additional gaming machine.

13. The method of claim 8 in which adjusting the bonus trigger probability data structure is further based on supplemental data comprising environmental state data.

14. The method of claim 8 in which adjusting the bonus trigger probability data structure is further based on supplemental data not directly adjustable by a player.

15. The method of claim 8 in which the player input comprises a player touch of a selected graphical element of the time-varying display theme sequence.

* * * * *